US006325247B1

(12) United States Patent
Iggulden

(10) Patent No.: US 6,325,247 B1
(45) Date of Patent: Dec. 4, 2001

(54) DEVICE FOR COLLECTING AND ABSORBING DRIPS ON A FLUID CONTAINER

(76) Inventor: Jerry Iggulden, 10345 W. Olympic Blvd., Los Angeles, CA (US) 90064

( * ) Notice: Subject to any disclaimer, the term of this patent is extended or adjusted under 35 U.S.C. 154(b) by 0 days.

(21) Appl. No.: 09/770,870

(22) Filed: Jan. 26, 2001

Related U.S. Application Data

(63) Continuation-in-part of application No. 09/549,905, filed on Apr. 14, 2000.

(51) Int. Cl.[7] ..... B65D 23/06

(52) U.S. Cl. ..... 222/108; 222/571; 215/41; 215/392; 215/258; 428/40.1; 428/41.7; 428/343; 428/354

(58) Field of Search ..... 222/108, 571; 220/695, 731; 215/251, 253, 258, 232, 41, 392, 394; 156/212; 428/42.2, 42.3, 41.7, 40.1, 906, 43, 343, 354

(56) References Cited

U.S. PATENT DOCUMENTS

| | | | |
|---|---|---|---|
| 134,302 | 12/1872 | Miller | 215/392 |
| 447,635 | 3/1891 | Day, Jr. | 215/392 |
| 571,088 | 11/1896 | Hamilton | 215/392 |
| 657,327 | 9/1900 | Williams | 215/392 |
| 811,742 | 2/1906 | Petrie | 215/392 |
| 1,182,993 | 5/1916 | Deeks | 215/392 |
| 1,449,335 | 3/1923 | Latham | 215/392 |
| 1,683,176 | 9/1928 | Faulhaber | 215/392 |
| 2,105,027 | 1/1938 | Davis | 222/108 |
| 2,918,033 | 12/1959 | Snyder | 116/206 |
| 2,918,893 | 12/1959 | Norton | 116/206 |
| 3,063,590 | 11/1962 | Hopkins | 215/392 |
| 4,437,583 | 3/1984 | O'Connor | 222/108 |
| 4,631,227 | 12/1986 | Nakamura | 428/343 X |
| 4,743,499 | 5/1988 | Volke | 428/343 |
| 4,784,653 | 11/1988 | Bolton et al. | 428/354 X |
| 5,484,635 | 1/1996 | Andersen et al. | 222/108 X |

FOREIGN PATENT DOCUMENTS

| | | | |
|---|---|---|---|
| 296 19 453-U1 | * | 4/1997 | (DE) . |
| WO-98/52831-A1 | * | 11/1998 | (EP) . |
| 2716867-A1 | * | 9/1995 | (FR) . |

* cited by examiner

*Primary Examiner*—Kenneth Bomberg
(74) *Attorney, Agent, or Firm*—Blakely, Sokoloff, Taylor & Zafman LLP

(57) ABSTRACT

In one embodiment, a device for collecting and absorbing drips on an exterior of a fluid container comprises a band of absorbent material placed around the neck of the fluid container. A capsule covers the neck of the container, including the absorbent material. When the container is prepared for use, the capsule is removed, thereby exposing the absorbent material. In another embodiment, absorbent material is applied to the inside of the capsule. When the container is prepared for use, a portion of the skirt of the capsule is left in place on the neck of the fluid container to collect and absorb drips.

9 Claims, 6 Drawing Sheets

DEVICE FOR COLLECTING AND ABSORBING DRIPS ON A FLUID CONTAINER

RELATED APPLICATION

This is a continuation-in-part of co-pending application Ser. No. 09/549,905 filed Apr. 14, 2000.

BACKGROUND OF THE INVENTION

1. Field of the Invention

The present invention relates generally to the field of fluid containers and, more particularly, to a device for collecting and absorbing drips of fluid that run down the side of a container after fluid is dispensed therefrom.

2. Background

Fluid dripping down the side of a fluid container is a common everyday annoyance. Quite often, table linens become soiled or stained as a result of drips on containers for beverages, condiments and the like. For example, a few drops of red wine dripping down the side of a wine bottle can easily ruin an expensive tablecloth. A number of approaches have been taken to solve this problem. A common solution, frequently used in restaurants, is the use of a cloth to cradle a bottle of wine as it is poured. The cloth collects any inadvertent drips of wine and can be used to wipe the outside of the bottle before the bottle is placed back on the table. This is a less than ideal solution, since the cloth then becomes stained and will likely need to be discarded. Another common solution is the use of a coaster. This is also less than ideal since drips deposited on the coaster may nevertheless find their way to the table surface.

A number of devices have been proposed for absorbing drips on the neck of a bottle. For example, U.S. Pat. No. 447,635 discloses an absorbent bottle collar made of a strip of blotting paper or the like, which is held in place around the neck of a bottle with a wire or other tie. U.S. Pat. No. 1,182,993 discloses a drip guard for a bottle comprising an absorbent elastic band. U.S. Pat. No. 3,063,590 discloses a drip arrester for a bottle in which an absorbent inner layer is laminated to a relatively non-absorbent outer layer. U.S. Pat. No. 4,437,583 discloses a dribble ring made of an absorbent foam having a plastic or rubber coating on the outer circumference and bottom of the ring. U.S. Pat. No. 5,484,635 discloses a drip catcher in the form of a waterproof pocket filled with an absorbent material that is adhesively secured to the outside of a fluid container.

SUMMARY OF THE INVENTION

The present invention represents an improvement over the drip-catching devices of the prior art. In one embodiment, a device for collecting and absorbing drips on an exterior of a fluid container comprises a band of absorbent material placed around the neck of the fluid container. A capsule covers the neck of the container, including the absorbent material. When the container is prepared for use, the capsule is removed, thereby exposing the absorbent material. In another embodiment, absorbent material is applied to the inside of the capsule. When the container is prepared for use, a portion of the skirt of the capsule is left in place on the neck of the fluid container to collect and absorb drips.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
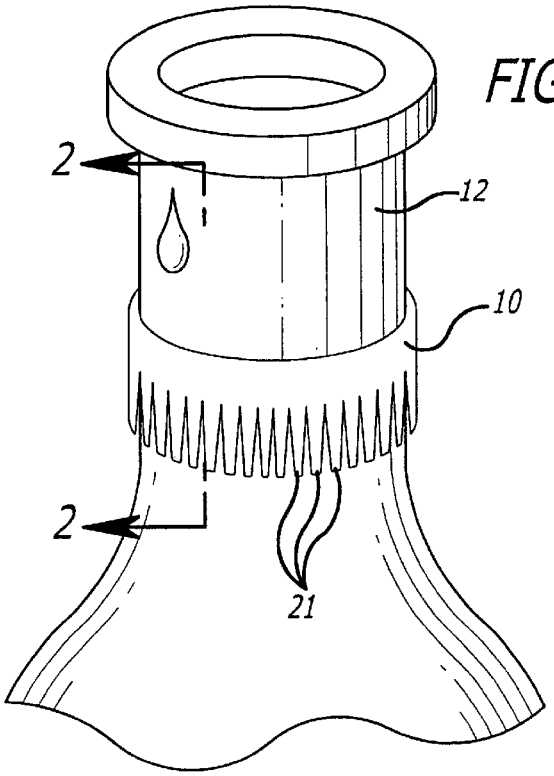
FIG. 1 is a perspective view of a first embodiment of the present invention.

FIG. 1 illustrates a first embodiment 10 of the present invention applied to the neck of a fluid container 12, such as a wine bottle. Device 10 preferably wraps entirely around the neck of container 12 with the ends of device 10 meeting or overlapping. In the case of containers having a large diameter neck or neckless opening, device 10 may be applied to only a portion of the circumference, it being understood that the contents of container 12 should then be poured in the direction of device 10.

Figure 2:
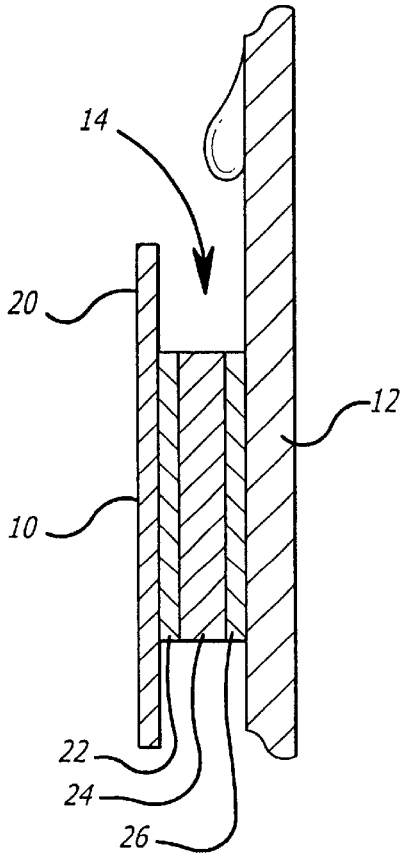
FIG. 2 is a cross-sectional view taken through line 2—2 of FIG. 1.

The layered construction of device 10 is illustrated in the cross-sectional view of FIG. 2. The outermost layer 20 comprises a thin, elongated strip of a material that is substantially impervious to the fluid in the container. For most applications, such as wine bottles and the like, strip 20 may be made of a semi-rigid plastic material, such as Mylar® or the like. Strip 20 may have a plurality of slits or notches 21 along its lower edge so that it can conform to a container having a tapered neck. Next to strip 20 is a layer 22 of an adhesive material, such as a double-sided adhesive tape. Layer 24 comprises an absorbent material. A variety of materials may be used, depending upon the characteristics and volume of the fluid to be absorbed. For applications such as a drip catcher on a wine bottle, a paper material, such as commonly used for paper towels, tissues or blotters, may be used. Woven materials, such as felt or cotton gauze and open-cell foam materials may also be suitable. The absorbent material of layer 24 may be treated with a deodorizer, if desired. Layer 26 again comprises an adhesive, such as a double-sided adhesive tape.

Layers 22, 24 and 26 are preferably narrower than strip 20 so that a channel or gutter 14 is created adjacent to the outer surface of fluid container 12. This aids in the collection of drips as they descend the side of container 12 and guides them to the layer of absorbent material 24. This is one reason why it is desirable to make strip 20 of a material that is substantially impervious to the fluid. Strip 20 also acts as a barrier for fluid collected in absorbent layer 24 so that an individual handling fluid container 12 will not be directly exposed to the collected fluid. The outer surface of strip 20 may be imprinted with a decorative design, a logotype or an advertising message. Thus, for example, if device 10 is applied to a wine bottle in a restaurant, strip 20 may be imprinted with the name and/or logotype of the restaurant.

Figure 3:
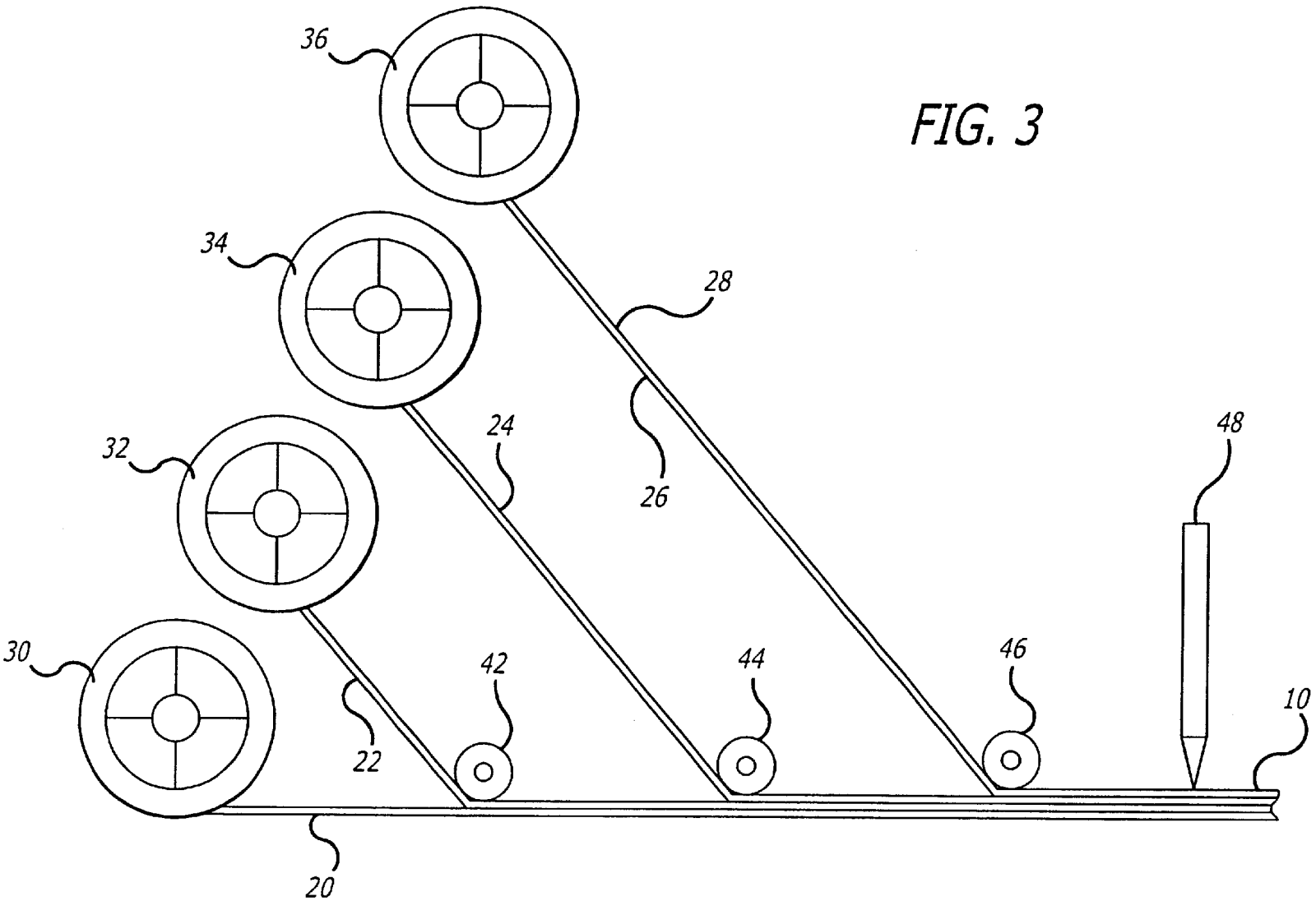
FIG. 3 illustrates a method for manufacturing the device shown in FIGS. 1 and 2.

FIG. 3 illustrates a method by which device 10 may be conveniently manufactured. Each layer is fed from a corresponding spool and laminated to make the final product. The material for layer 20 is fed from spool 30 and a double-sided adhesive tape for layer 22 is fed from spool 32. These are laminated under pressure roller 42. Next, the absorbent material for layer 24 is fed from spool 34 and laminated to adhesive layer 22 under pressure roller 44. Finally, a double-sided adhesive tape for layer 26 is fed from spool 36 and laminated to absorbent layer 24 under pressure roller 46. Adhesive layer 26 preferably includes a backing material 28 to protect the adhesive until device 10 is applied to a fluid container. After all the layers are laminated, the resulting strip passes under guillotine chopper 48 to be cut to the appropriate length. For a typical 750 milliliter wine bottle, the length of finished device 10 is preferably in the range of approximately 3½ inches to 5½ inches. The width of device 10 is not critical, provided that there is a sufficient quantity of absorbent material to absorb the amount of fluid that may be anticipated to drip down the fluid container. For a wine bottle device, the width of device 10 is preferably in the range of approximately ⅜ inch to 1 inch. The preferred thickness of absorbent material 24 is likewise a function of the anticipated volume of absorbed fluid. However, it is important that the thickness be sufficient so that the gutter 14 will be large enough to receive a drip of fluid. If the gutter is too narrow (i.e., if absorbent layer 24 is too thin), drips will have a tendency to flow across the gutter and down the side of layer 20, thereby defeating the purpose of device 10.

Figure 4:
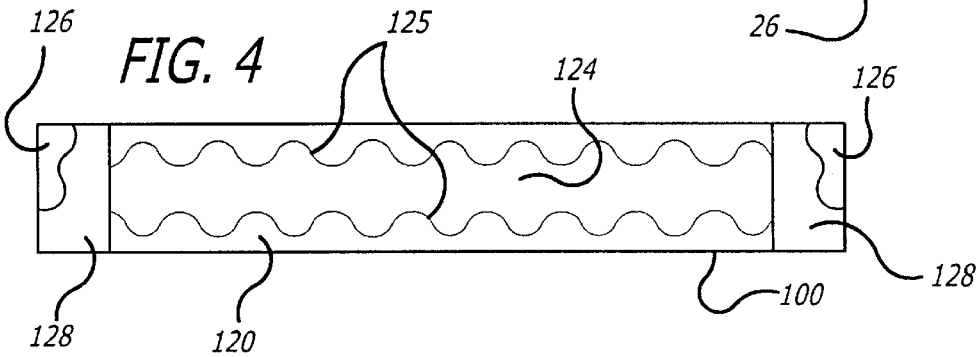
FIG. 4 is a plan view of an alternative embodiment of the invention.
Figure 5:
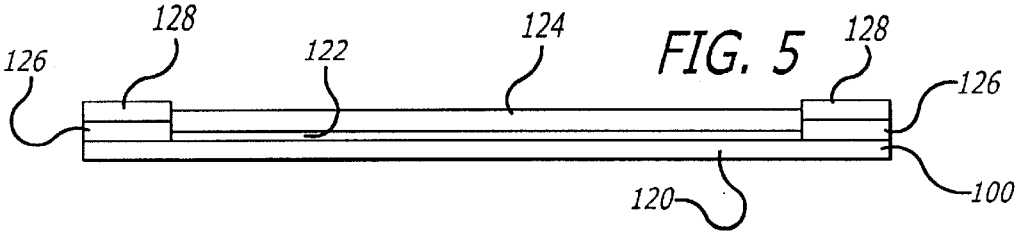
FIG. 5 is a side view of the device shown in FIG. 4.

An alternative embodiment 100 of the invention is illustrated in FIGS. 4 and 5. Device 100 is generally similar in construction to device 10. Layer 120 serves the same functions as layer 20 of the previously-described embodiment and may be made of the same fluid-impervious material. Absorbent layer 124, however, is quite different from layer 24. In this embodiment, absorbent layer 124 is formed with a powdered or granulated material. A material particularly suitable for use in this embodiment is a cross-linked acrylic polymer marketed by Chemdal Corporation of Arlington Heights, Illinois under the trademark Aridall®. This material is highly effective in absorbing aqueous fluids, such as wine. Layer 124 may be formed with scalloped edges 125, as illustrated, to increase the surface area that intercepts drips of fluid. The material for absorbent layer 124 is secured to layer 120 with a suitable adhesive 122. The adhesive is preferably a non-water based liquid adhesive that is applied with a sprayer, roller or brush. One such suitable adhesive is Scotch® brand "Photo Mount" spray adhesive.

In this embodiment, it is not practical to apply another adhesive layer over the absorbent layer. Therefore, in order to attach device 100 to a fluid container, adhesive regions 126 are provided at each end of device 100. The adhesive used in regions 126 may be a double-sided adhesive tape as used for layers 22 and 26 of the previously-described embodiment. A suitable backing material 128 may be applied over adhesive regions 126 or over the entire back of device 100, thereby protecting absorbent layer 124. To apply device 100 to a fluid container, one of adhesive areas 126 is attached directly to the outside surface of the container and the device is then wrapped around with the other adhesive region 126 being applied to the exposed surface of layer 120.

Figure 6:
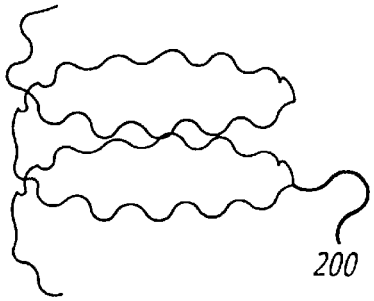
FIG. 6 is a perspective view of another alternative embodiment of the invention.

Another alternative embodiment 200 of the present invention is illustrated in FIG. 6. Device 200 comprises a wire that has been coated with an absorbent material, such as the Aridall® material described above. The wire is formed into a shape to encircle a portion of a fluid container, such as the neck of a wine bottle. Device 200 may have undulations as illustrated in FIG. 6 to increase the surface area available for absorbing drips. The wire member of device 200 is preferably made of a sufficiently resilient material and is formed into a helical shape so that the device can be applied to containers of varying diameters and will maintain intimate contact with the outside surface of the container. The "wire" may be metallic or may be formed of a resilient plastic material, such as Nylon.

Figure 7:
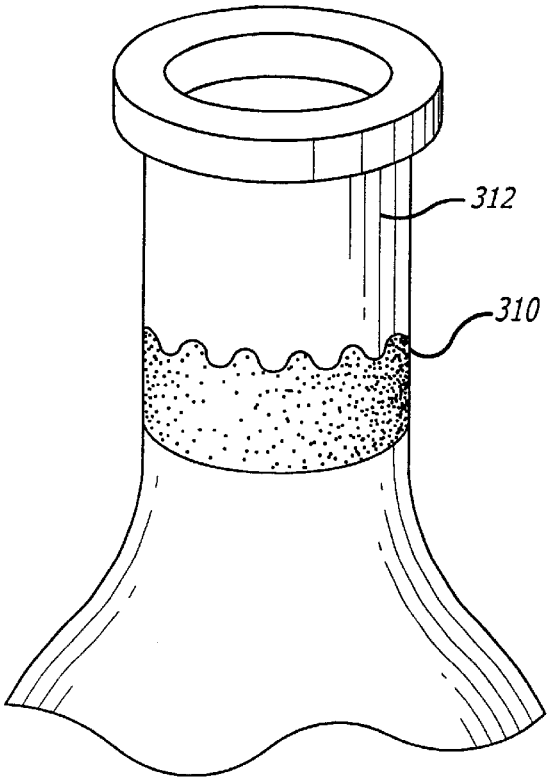
FIG. 7 is a perspective view of still another alternative embodiment of the invention.

The previously described embodiments of the invention comprise devices that are applied as a separate item to a fluid container. These may be applied by a consumer or may be applied to the container at any appropriate time during the container manufacturing process or container filling process. The present invention may also be embodied as an absorbent coating applied directly to the fluid container as illustrated in FIG. 7. Here, fluid container 312 has a drip-absorbing region 310 on the neck of the container or otherwise proximate to an aperture through which fluid is dispensed. Drip-absorbing region 310 may comprise a powdered or granulated absorbent material, such as the Aridall® material described above, or other suitably absorbent "flocking" material. In such case, a suitable adhesive is applied to the fluid container in the drip-absorbing region to bind the absorbing material thereto. This may be conveniently accomplished, for example, during a bottling process. Drip-absorbing region 310 may also comprise other absorbent materials, including paper materials, woven materials, etc., as described in connection with device 10.

Figure 8:
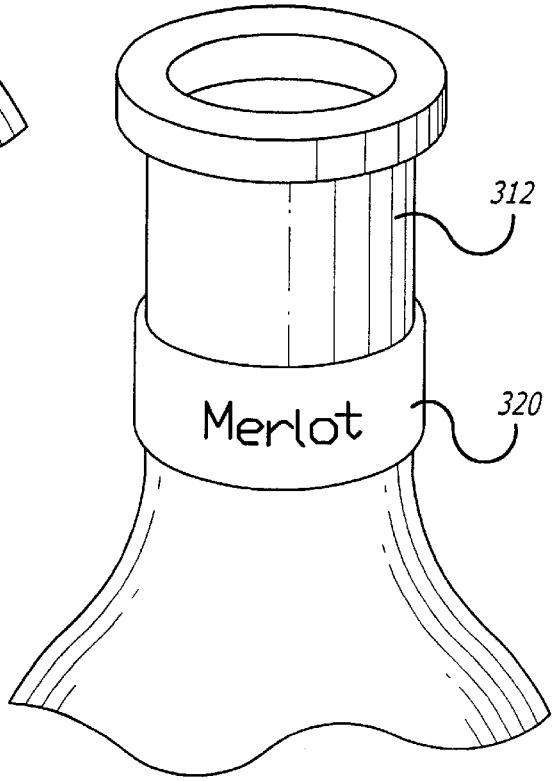
FIG. 8 is a perspective view of a modification of the embodiment shown in FIG. 7.

Referring now to FIG. 8, a drip-absorbing region 310 as described above may have an outer layer 320 made of a plastic or other fluid-impervious material. Layer 320 may extend above the drip-absorbing region to form a channel or gutter as has been previously described. Also, layer 320 may be imprinted with a decorative design, a logotype or an advertising message. Thus, layer 320 and the underlying drip-absorbing region 310, may be applied to a fluid container in place of a conventional neck label.

Figure 9:
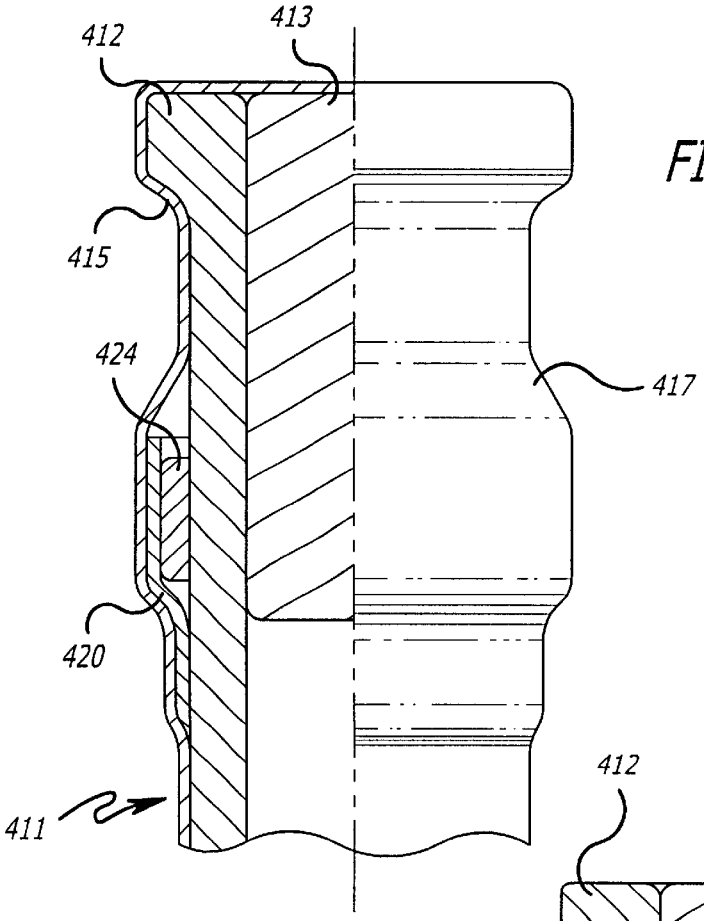
FIG. 9 is a partial cross-sectional view of yet another alternative embodiment of the invention.
Figure 10:
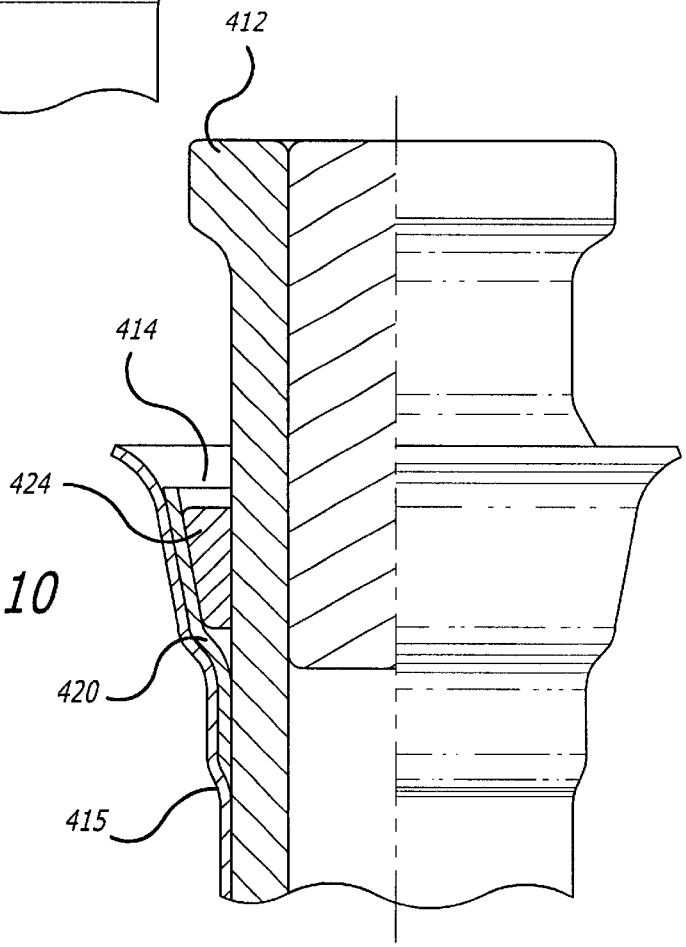
FIG. 10 is partial cross-sectional view of the embodiment of FIG. 9 after it has been prepared for use.

FIG. 9 illustrates another embodiment of the present invention. Here, a layer of absorbent material 424 is placed around the neck 411 of a fluid-containing bottle 412. Bottle 412 has a metallic foil or plastic "capsule" 415 of the type that is commonly used to seal the cork 413 of a bottle of still wine. The absorbent layer 424 is disposed within capsule 415 and is surrounded by a band 420 made of a plastic or other substantially fluid-impervious material. When bottle 412 is opened, at least the upper portion of capsule 415 must be removed to gain access to the cork 413. Traditionally, this is accomplished by using a foil cutter to slit the capsule circumferentially around the neck of the bottle just below the lip of the bottle. Many capsules, particularly those made of plastic, are now provided with a tear strip so that a foil cutter is not required. Absorbent layer 424 may be exposed in a similar manner, as illustrated in FIG. 10. A foil cutter or tear strip 417 is used to open the capsule immediately above the location of absorbent layer 424. The resiliency of the absorbent material aids in urging both the capsule 415 and band 420 radially outward, thereby opening gutter 414. Band 420 may be made of suitably resilient material and/or may be formed with an upward opening flare to insure that an adequately dimensioned gutter is formed. The capsule material itself may perform this function, in which case a separate band 420 is not necessary. In some applications, particularly for relatively viscous fluids such as cooking oil, honey, syrup, etc., a layer of absorbent material 424 may not be necessary. A gutter 414 alone may be sufficient to collect drips of such viscous fluids. Fluid collecting in the gutter may then be removed with a sponge or towel.

Figure 11:
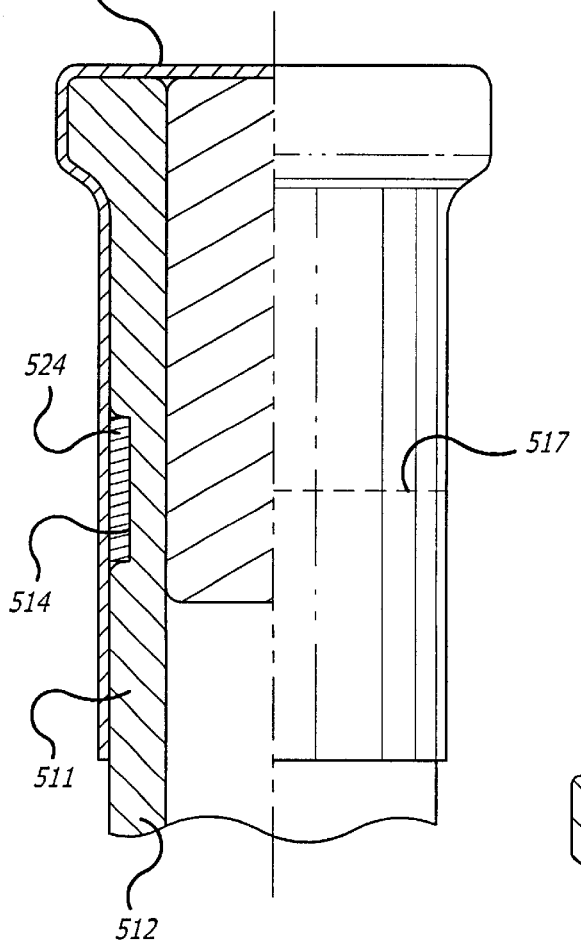
FIG. 11 is a partial cross-sectional view of another alternative embodiment of the invention.

FIG. 11 illustrates yet another embodiment of the present invention. In the just-described embodiment of FIGS. 9–10, the absorbent material 424 creates a bulge in capsule 415, which may be considered unsightly. With reference to FIG. 11, neck 511 of bottle 512 is formed with an annular groove or indentation 514. A band of absorbent material 524 is placed within groove 514. Material 524 may be preformed as a band that may be stretched and then slipped over neck 511 to rest within groove 514 or may be a strip of material having a length equal to the circumference of neck 511 that is secured within groove 514 by an adhesive (not shown).

A capsule 515 is placed over neck 511, including absorbent material 524. As can be seen, there is no bulge in capsule 515 due to the absorbent material since the outer surface of this material is approximately flush with the surface of neck 511. When it is desired to open bottle 512, capsule 515 may be removed in a conventional manner using a foil cutter or the like. All or substantially all of the capsule is then removed from neck 511 in order to expose absorbent material 524. Alternatively, capsule 515 may be scored or perforated at 517 in the vicinity of absorbent material 524 to facilitate the removal of the capsule foil and thereby expose material 524. In this manner, a portion of the capsule may be left in place over the lower part of material 524 to provide a partial protective barrier. In lieu of perforations, capsule 515 may be provided with a tear strip such as described above. Alternatively, capsule 515 may simply have a printed or die-cut mark at an appropriate location to facilitate removal of the capsule by peeling with the fingers or using a foil knife.

Figure 12:
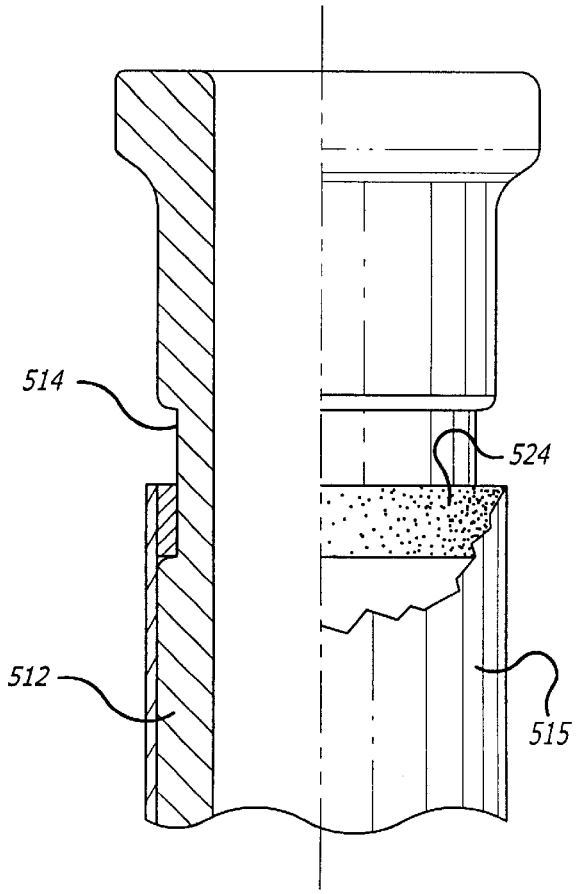
FIG. 12 is a partial cross-sectional view of a modification to the embodiment of FIG. 11.

Despite the presence of absorbent material 524 on the neck of bottle 512, there is a possibility that a drop will simply roll down the surface of the absorbent material rather than be absorbed into it. To counter this possibility, the upper portion of the absorbent material within groove 514 may be removed as illustrated in FIG. 12. By doing so, drops descending the neck of bottle 512 will tend to flow into the groove and be absorbed into the remaining portion of the material. The absorbent material preferably has a "grain" oriented in a circumferential direction so that the material can be separated or torn along line 517 without leaving a ragged edge. A relatively clean edge is aesthetically more pleasing and promotes the absorption of drops. The absorbent material 524 may be scored circumferentially to assist in removing the upper portion of the material, although such scoring may not be necessary if the material has a sufficiently well defined "grain".

Figure 13:
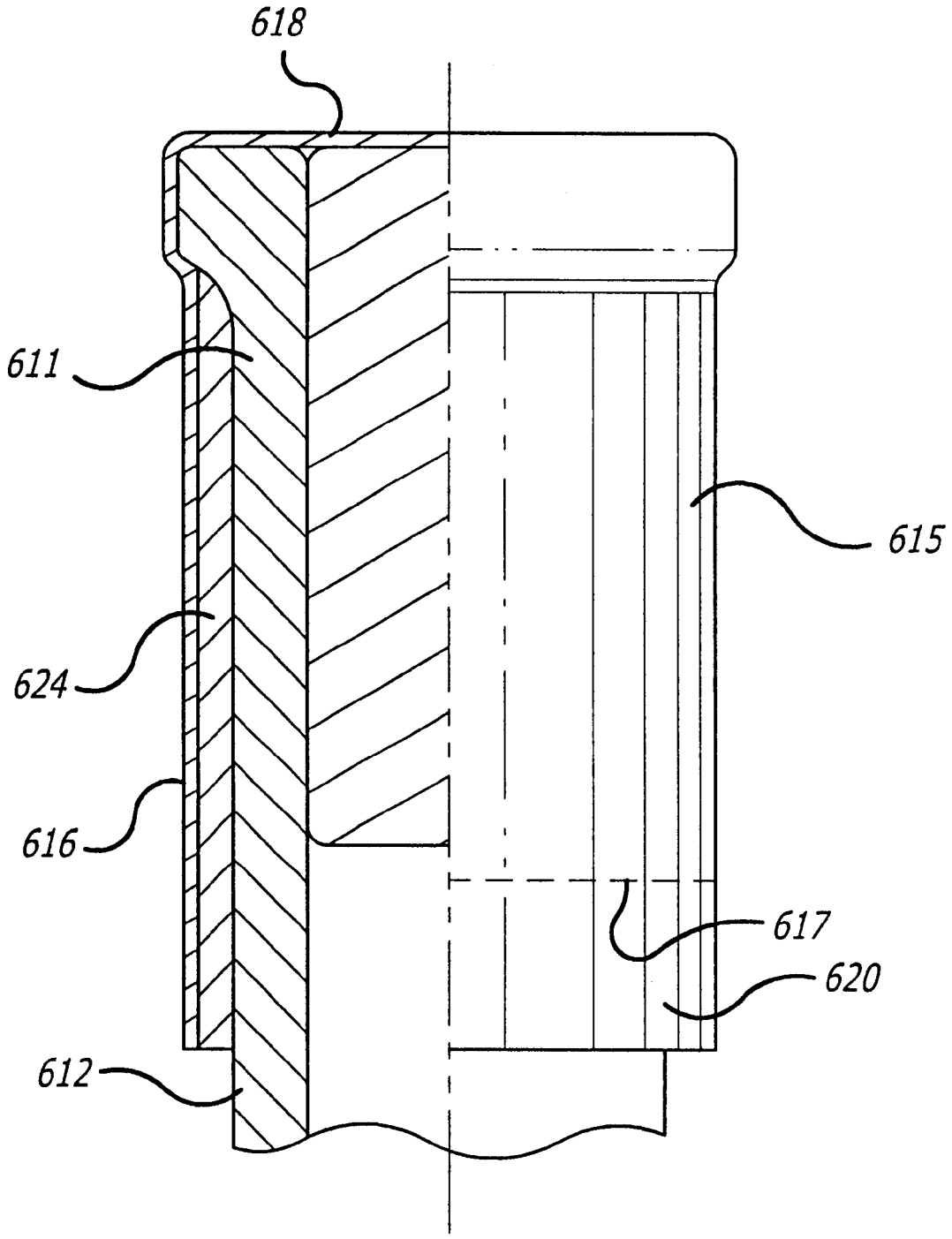
FIG. 13 is a partial cross-sectional view of still another alternative embodiment of the invention.

Still another embodiment of the present invention is illustrated in FIG. 13. In this embodiment, absorbent material 624 lines the inside of the skirt portion 616 of capsule 615. The cap portion 618 of capsule 615 may be free of absorbent material 624 so that the capsule has a smooth contour when fitted to neck 611 of bottle 612. Absorbent material 624 may be cut from suitable sheet material, such as felt, open-ell foam, etc., and adhesively bonded to the capsule material. Alternatively, absorbent material 624 may be a particulate material, such as Aridall® discussed above, that is applied as a coating to the capsule material. In either case, absorbent material 624 preferably has a thickness of approximately 1/16 inch or more so that the exposed edge can effectively collect and absorb drops of fluid.

Capsule 615 is preferably scored or perforated at 617 such that the cap portion and upper skirt portion may be removed from bottle 612, leaving a band 620 around neck 611. A similar construction may be advantageously employed with twist-off caps. Such caps typically have a collar portion that remains on the bottle neck. By adding an absorbent material to this collar portion, an effective drip catcher may be easily provided.

In a variation of the just-described embodiment, absorbent material 624 may be applied to neck 611 of bottle 612 instead of capsule 615. In such case, capsule 615 is still preferably scored or perforated at 617 so that the cap portion and upper skirt portion may be removed, while leaving a band 620 of the capsule material around neck 611. The exposed absorbent material 624 above band 620 is then removed. Absorbent material 624 preferably has a grain oriented in a circumferential direction as described above to facilitate the removal of the upper portion of the absorbent material and leave a relatively clean edge at the top of band 620 for absorbing drops of fluid.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims. In particular, whereas the invention has been specifically described in terms of embodiments intended for use on a wine bottle, the invention is also applicable to containers for other fluids, including, for example, household products, such as glue, paint, oil, etc. and kitchen products such as honey, catsup, vinegar, cooking oil, sauces, dressings, etc.

What is claimed is:

1. A fluid container comprising:

a body portion;

a neck portion having an opening therein, the neck portion having a circumferential indentation in an outer surface thereof; and a band of absorbent material disposed within the indentation, wherein the band of absorbent material is scored circumferentially such that a portion thereof may be removed from the indentation.

2. The fluid container of claim 1 wherein the band of absorbent material is approximately flush with the outer surface of the neck portion.

3. The fluid container of claim 1 wherein the band of absorbent material is adhesively secured within the indentation.

4. The fluid container of claim 1 wherein the band of absorbent material has a grain oriented in a circumferential direction.

5. The fluid container of claim 1 further comprising a capsule covering the neck portion of the container, including the band of absorbent material.

6. The fluid container of claim 5 wherein the capsule includes means for separating the capsule adjacent to the band of absorbent material.

7. A fluid container comprising:

a body portion;

a neck portion having an opening therein;

a band of absorbent material disposed around the neck portion, wherein the band of absorbent material is scored circumferentially such that a portion thereof may be removed; and a capsule having a cap portion and a skirt portion, wherein the skirt portion surrounds the band of absorbent material.

8. The fluid container of claim 7 wherein the band of absorbent material has a grain oriented in a circumferential direction.

9. The fluid container of claim 7 wherein the capsule includes means for separating the capsule adjacent to the band of absorbent material.

* * * * *